United States Patent [19]

Urbain

[11] 4,233,098

[45] Nov. 11, 1980

[54] METHOD OF MAKING METAL-PLASTIC SKI

[75] Inventor: Daniel Urbain, Thionville, France

[73] Assignee: Laminoirs a Froid de Thionville, Thionville, France

[21] Appl. No.: 889,867

[22] Filed: Mar. 24, 1978

[30] Foreign Application Priority Data

Mar. 24, 1977 [FR] France ..... 77 08881

[51] Int. Cl.[2] ..... A63C 5/12

[52] U.S. Cl. ..... 156/242; 156/250; 156/256; 156/293; 280/609; 280/610; 280/608; 156/245

[58] Field of Search ..... 156/242, 245, 293, 250, 156/256; 280/601, 608, 609, 610; 9/310 R, 310 B, 310 E

[56] References Cited

U.S. PATENT DOCUMENTS

| | | | |
|---|---|---|---|
| 2,694,580 | 11/1954 | Head | 280/610 |
| 3,194,572 | 7/1965 | Fischer | 280/610 |
| 3,201,138 | 8/1965 | Brown | 280/610 |
| 3,395,928 | 8/1968 | Eglit | 280/610 |

*Primary Examiner*—Caleb Weston

*Attorney, Agent, or Firm*—Brisebois & Kruger

[57] ABSTRACT

A process of making a metal-plastic ski by cold gluing on a core of plastic material, upper and lower laminated structures. The laminated structures which form the upper and lower portions of the ski are each previously formed by "Coil-Coating" and have inner surfaces with a thin coating of a material with excellent glue adhesion characteristics. The upper surface of the upper structure is precoated with a thicker layer of plastic material which forms the upper surface of the ski, and the lower surface of the lower structure is precoated with plastic material which forms the sliding bottom surface of the ski.

9 Claims, 1 Drawing Figure

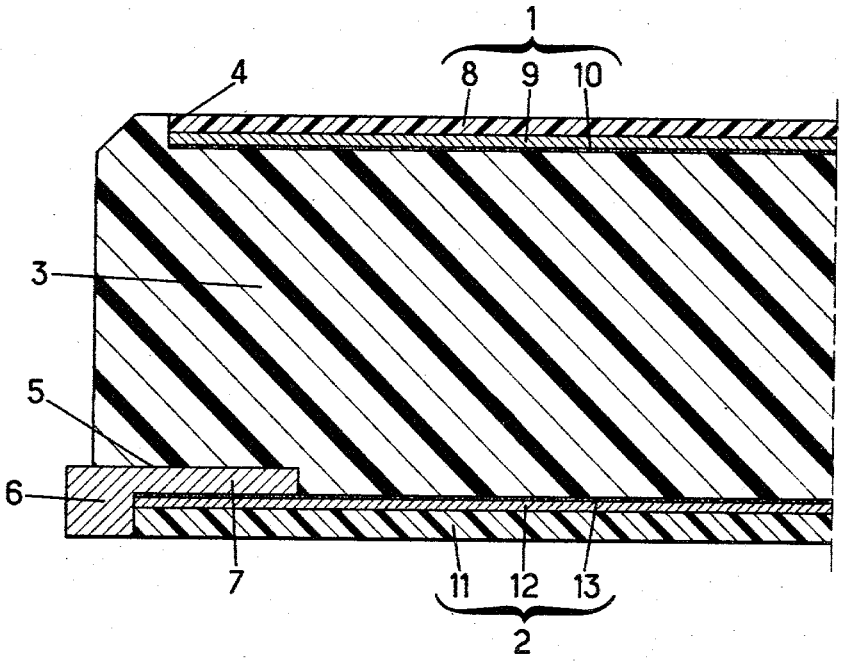
1
4
8
9
10
3
5
6
7
11
12
13
2

METHOD OF MAKING METAL-PLASTIC SKI

This invention relates to the manufacture of metal-plastic skis of the type in which two strong planar structures formed from metal are joined to opposite faces of a core which functions as a brace and spacer for the planar structures.

Such skis are presently manufactured by two methods. The first method requires skilled workmen and consists of hand shearing the two metal structures from a metal sheet, machining the core which is usually formed either partly or wholly from wood, gluing the three elements as well as the metal ski edges together using a glue, such as a multi-component epoxy cement which sets while cold, or can be warmed, but in either event requires a relatively long period of time for its polymerization. Such a bonded assembly is then finished to level the different components and smooth the edges of the ski. While this technique requires little initial investment, considerable skilled labor is required and productivity is low. It is thus evident that skis manufactured in this manner are always quite expensive.

There is also a second more industrial technique for forming metal-plastic skis. This method consists in cutting the two metal structures from a metal sheet in a blanking press, then introducing these metal structures and the ski edges into an injection mold, and injecting a plastic material into the mold to form a core which adheres or bonds to the edges and the metal sheet structures. Since such molds must support the injection pressures, they are quire expensive because of their length. In addition, a different mold is required for each different type and size of ski. Also, the different components must be very carefully placed in the mold before injection, and therefore, production is quite slow. Moreover, there is always a considerable investment in the molds which must be absorbed or written-off because of the small number of skis manufactured, since competition does not permit marketing a very large number of different models, and rapid technical developments in this field frequently require abandonment of existing models for more advanced models. As a result, the skis produced by this second molding techinque method are also very expensive.

Finally, in both the above mentioned manufacturing procedures, coverings or coatings must be added to the upper and lower surfaces of the laminated ski. Specifically, a bottom or sliding surface must be added to the bottom of the ski and the top of the ski requires coating so that the metal is not exposed. These coatings can also be cut and glued, or can be injected from another material different from the core and in a separate injection operation, which constitutes an additional complication.

Known in the art is a process of continuous application of an organic product to a metal sheet, this process often being designated by the term "Coil-Coating". In this process, a metal sheet, usually steel or aluminum, is fed as a continuous band from a reel or coil, through a unique coating apparatus and is subjected to a number of operations selected and combined as a function of the desired coatings and end results to be obtained. These operations can include:

- cleaning and degreasing
- chemical surface treatments to enhance resistance to corrosion

- applying coatings of liquid or viscous organic products
- heating or baking
- applying coatings or films of organic material sheets previously heated and coated with an adhesive
- applying coatings of powdered organic products
- applying melted organic products in a uniform layer.

As a variation of this technique, installations are known in which pre-cut plates of the metal can be processed in essentially the same manner.

These processes have the advantage of manufacture at a low cost, since little direct labor is required, while attaining excellent and constant quality, due to the automatic and continuous nature of the operations.

Of considerable importance is the excellent bonding of the various materials to the metal substrate, which occurs because of the use of elevated temperatures. In particular, one can obtain coatings of acrylonitrile butadiene styrene (ABS) or polyvinyl chloride (PVC) which are so well bonded to the substrate that coating tests regularly result in rupture of rather than the peeling of such plastic materials from the substrate.

It is known that direct gluing of a metal sheet on a wooden or plastic material core of a ski has disadvantages. Where a multi-component glue, such as epoxy, is used, and the glue is cold cured, the "pot life" or duration of possible use of the mixture is relatively short, and much shorter than the time required for curing of the glue in the assembled ski. Use of such multi-component glue requires expensive continuous mixing gluing machines. On the other hand, satisfactory higher temperature curing glues are more expensive, and differential expansion problems are encountered which make precision manufacture of the ski quite difficult. It has been found in addition that if these glues have good holding power during shearing, they usually exhibit average or mediocre resistance to peeling, and in any event are very inferior to the coatings obtained by "Coil-Coating". Another disadvantage of the direct gluing technique is the need to treat the metal before gluing, for example, in the case of aluminum alloys, to treat the metal in a hot sulpho-bromic bath. Cold mono-component glues which harden by solvent evaporation would indeed permit easier and faster gluing, but the characteristics of the bonded assembly would be quite inferior to those required for ski manufacture.

The object of this invention is to provide a metal-plastic ski of excellent quality, the manufacture of which requires a minimum of labor and a minimum investment for each particular type and size of ski.

The invention comprises using the known process, such as the "Coil-Coating" process for continuous application on a metal sheet of an organic product, preferably thermoplastic, in order to prepare a first semi-finished coated metal sheet to constitute the upper planar structure, and coated on one surface with a relatively thick coating which constitutes the upper face of the ski, and on the other surface with a thin coating of organic material which is preferrably thermoplastic, a second semi-finished metal sheet constituting the lower structure of the ski and coated on one surface with a thick plastic coating constituting the slide or running surface of the ski, and on the other surface with a thin intermediate coating of an organic preferrably thermoplastic material, cutting from these two semi-finished products respectively the top and bottom planar structures of the ski, molding a ski core having an upper groove for the top and lower grooves for the edges by direct molding without addition of the metal reinforcement, and finally gluing onto the core, the ski edges and the top and bottom of the ski using a cold mono-component glue as a solvent to glue the two intermediate coatings of the metal sheets onto the core, the intermediate coatings and the core preferrably being of identical plastic material.

While the glue is drying, pressure is maintained on the ski vertically and horizontally. As a variation, the thin inner edge of the ski edges can be glued directly onto the bottom of the ski as a first step, and next, the upper and lower metal sheets are glued onto the assembly of core and edges, using a simple cambered former pattern for pressing the assembly together.

Other features and details of the invention will become apparent from the description which follows of one embodiment taken as an example, and shown in the attached drawings which shows an enlarged partial vertical section of the ski.

This invention uses to advantage the good adherence of the plastic layers deposited on the metal sheet and which are obtained rapidly and at a high temperature in the above-mentioned process of "Coil-Coating". By depositing on the metal, by this process an intermediate fixation layer of a chemical substance which is compatible with the material of the core, in such a way that these two materials which can be identical, permit the rapid cold gluing of the intermediate layer directly on the core. In this manner one obtains artifically, an effective gluing of the metal layer on the core of plastic material because of the good adherence of the intermediate layer to the metal, and the good adherence of the intermediate layer on the core by cold gluing.

As an example, one can advantageously make by the above technique, a first semi-finished product or tempered carbon steel sheet with an elastic limit of 150 $kg/mm^2$, and of a thickness of about 3 to 5/10 mm, coated on one surface with a thick coating of for example, ABS plastic intended to decorate and cover the top of the ski and on the surface a thin layer also of ABS plastic to constitute the gluing intermediary. In the same way a second semi-finished product can be made beginning with a metal sheet of the same type and comparable thickness, coated on one surface with the same thin layer of ABS plastic serving as the gluing intermediary, and on the other surface with a thick sheet of grafted polyethylene whose adhesion to the metal is through the intermediary of an anti-corrosion primer and possibly an intermediary surface as explained above.

In accordance with the invention, the two semi-finished metal laminate sheets, in the form of a continuous band or sheet are then cut preferrably with a press using a punch and die assembly to form respectively, an upper structure 1 constituting the top of the ski and a lower structure 2 constituting the bottom of the ski. These two pieces when cut naturally have a profile which corresponds exactly to the development of the profile of the ski reduced by a small lateral margin.

The core 3 is preferrably constructed from ABS plastic preferrably by injection molding. Advantageously, the core can have weight reducing hollows opening on either or both surfaces, or can be made by interfitting of several layers, or can be formed from several pieces joined end to end to enable use of molds of smaller dimensions. Where the core is made of several parts, the various pieces constituting the core can readily be glued together using a solvent for ABS such as methylethylketone (MEK) or a special glue for ABS plastic which includes this same solvent.

Conforming to the invention, the upper surface of core 3 includes a groove 4 corresponding exactly in width and profile to the upper structure 1 of the ski, and the depth of groove 4 corresponds to the thickness of the structure 1. The lower surface of core 3 includes outwardly opening grooves 5 acting as seats for the square edges 6 and their internal portion or extension 7. The distance between the bottom surface of edge 6, and the bottom surface of its inner extension 7 corresponds in thickness to the thickness of bottom 2.

As shown at the drawing, the upper structure comprises a relatively thick covering 8 on the upper surface of a metal sheet 9, and an intermediary layer 10 on the bottom of metal sheet 9. Lower structure 2 comprises a relatively thick runner or ski bottom surface 11 on the lower surface of a metal sheet 12, and an intermediary layer 13 on its upper surface. As previously explained, where core 3 is of ABS plastic, intermediary layers 10 and 13 are of the same material, running surface 11 can be grafted polyethylene, and top surface 8 of the ski can be a desired plastic material such as ABS. With the upper and lower structures preformed in the manner previously explained, a ski can be manufactured quite simply by gluing the upper structure 1 to the top of the ski and the lower structure 2 to the bottom of the ski using methylethylketone or some special ABS plastic glue without heating or other special treatment. The square edges 6 are inserted and gripped between the edge of the core and the edge of the bottom, and are glued at the same time. For gluing the edges, an epoxy resin can be used which it is not necessary to keep under pressure during its polymerization, since the assembly is held together in one piece from the drying of the ABS glue. It is necessary however from the start of gluing, to press the square edges horizontally inwardly at the same time that pressure is applied to the top and bottom of the ski.

It is however preferrable, in accordance with the invention, to first glue the square edges 6 at their inner extensions 7 onto the bottom structure 2 so that at the time of manufacture of the final ski it is only necessary to press the three components of the sandwich vertically. In addition, the square edges can also be pretreated in a continuous manner, as described above, to provide thin intermediary layers to facilitate glue adherence. In this case, the gluing of the square edges onto the bottom is accomplished by the simple expedient of using methylethylketone, assembly is facilitated, and the adherence of the edges is very effective.

Naturally, the thickness of the metal sheets 9 and 12 is a function of the strength and the desired characteristics of the ski. Thicker sheets can be used where a stiff ski is desired, and thinner sheets can be used to provide a more flexible ski. The square edges 6 can be of the elastic or stressed type. In this latter case, since the elastic elongation of the edges is in general less than that of the metal sheets 9 and 12, it is advantageous to select thicknesses for the sheets 9 and 12, or their sections, in such a manner that the neutral fiber of the assembly constituted by the two structures and the square edges is at a smaller distance from the bottom of the ski than from the top of the ski, the two distances being in the relationship of the coefficients of elastic elongation of the metal of the square edges and the metal of the upper and lower structures.

Correspondingly, in accordance with this invention, manufacture of the semi-finished metal structures in sheet form is at a very high production rate, and likewise, the press cutting of such sheet to form the top and the bottom structures of the ski is accomplished quite rapidly. In addition, the fabrication of core 3, by simple molding without the requirement for introduction of any components into the mold is accomplished at a high rate with simple cooling. Finally, the gluing of the elements to form the assembly can be accomplished in a rapid manner by cold gluing, by simply pressing the assembly of the elements of the sandwich together for example, using clamps or elastic devices and possibly a counterpiece, directly against a curved or cambered pattern for example of wood, and which does not require a profile in plan where the square edges are previously glued onto the bottom.

Correspondingly, in accordance with this invention skis of high quality can be fabricated with minimum investment particularly because of the perfect gluing obtained, and without the prohibitive use of skilled labor.

What is claimed is:

1. A process for fabricating a metal plastic ski including a plastic core between a top metallic structure and a bottom metallic structure, said process comprising the steps of forming a core for the ski by molding a thermoplastic material soluble in a solvent, said core having a shallow top recess and a shallow bottom recess for nesting respectively the top and bottom metallic structures of the ski;

obtaining a first semi-finished metal laminate sheet having a high elastic limit and precoated with an organic coating on each surface thereof by a continuous coating process during which said sheet is cleaned, chemically treated, coated on one surface with a protective coating constituting the upper covering of the ski, coated on its other surface with an intermediary gluing layer of a substance soluble in at least said solvent and said coatings are cured;

obtaining a second semi-finished metal laminate sheet having a high elastic limit and precoated with an organic coating on each surface thereof by a continuous coating process during which said second sheet is cleaned, chemically treated, coated on one surface with a material constituting the runner surface of the ski, coated on its other surface with an intermediary layer of a substance soluble in at least said solvent, and said coatings are cured;

cutting said first and second semi-finished metal laminates to predetermined profiles, similar respectively to profiles of said top and bottom recesses, to form said top and bottom metallic structures of the ski;

applying to said intermediary gluing layers of said top and bottom structures a cold glue comprising at least said solvent; and nesting said top and bottom structures in said top and bottom recesses of said core and pressing said structures against said core to form a ski.

2. A process according to claim 1 wherein said step of obtaining said sheets comprises selecting a first sheet of a predetermined thickness, selecting a second sheet of a predetermined thickness, and assembling said ski said assembling including securing ski edges to said core, said thicknesses cooperating with said ski edges to provide a neutral fiber in the core of the ski at a distance closer to the bottom structure than the upper structure.

3. A process according to claim 1, wherein said material of the second semi-finished metal laminate constituting the runner surface of the ski, comprises a thick sheet of grafted polyethylene hot laminated onto said second sheet.

4. A process according to claim 1 wherein said step of obtaining the first metal sheet comprises selecting a sheet of tempered carbon steel coated on both sides with ABS plastic, said step of obtaining said second metal sheet comprises selecting a sheet of steel of comparable thickness with the first sheet and coated on one surface with a thin layer of ABS constituting said intermediary gluing layer, and coated on the other surface with a layer of grafted polyethylene, said step of forming said core comprises injection molding said core from ABS plastic, and said step of cold gluing comprises cold gluing with an ABS plastic glue.

5. A process according to claim 1 wherein said step of forming said core comprises, forming a core with shallow lower grooves and securing metallic ski edge strips in said grooves to form said shallow bottom recess of said core, said step of securing comprising coating said ski edge strips with an intermediary gluing layer of a substance soluble in at least said solvent, and nesting said strips in said grooves before the step of nesting said bottom structure in said bottom recess.

6. A process according to claim 5, wherein said thermoplastic material for molding the core, and said substance of said intermediary gluing layers of said first and second semi-finished laminates and of said ski edge strips are made from the same base material.

7. A process according to claim 6, wherein said base material is ABS plastic, and said solvent is a solvent for ABS.

8. A process according to claim 7, wherein said steps of obtaining said first and second metal laminates comprise, selecting two sheets of a tempered carbon steel of high elastic limit of 3-5/10 mm thickness.

9. A process according to claim 7, wherein said steps of obtaining said first and second metal laminates comprise, selecting two sheets of aluminum alloy of high elastic limit of 5-10/10 mm thickness.

* * * * *